US010783816B2

(12) United States Patent
Dong et al.

(10) Patent No.: US 10,783,816 B2
(45) Date of Patent: Sep. 22, 2020

(54) AMPLITUDE CONTROL MAIN CIRCUIT, VOLTAGE SUPPLY MODULAR CIRCUIT, DISPLAY DEVICE AND AMPLITUDE CONTROL METHOD

(71) Applicants: BOE TECHNOLOGY GROUP CO., LTD., Beijing (CN); CHONGQING BOE OPTOELECTRONICS TECHNOLOGY CO., LTD., Chongqing (CN)

(72) Inventors: Xing Dong, Beijing (CN); Heecheol Kim, Beijing (CN); Zhi Zhang, Beijing (CN); Xiuzhu Tang, Beijing (CN); Shuai Chen, Beijing (CN); Lijun Xiong, Beijing (CN); Jingpeng Zhao, Beijing (CN); Taoliang Tang, Beijing (CN); Min Ran, Beijing (CN)

(73) Assignees: BOE TECHNOLOGY GROUP CO., LTD., Beijing (CN); CHONGQING BOE OPTOELECTRONICS TECHNOLOGY CO., LTD., Beibei, Chongqing (CN)

( * ) Notice: Subject to any disclaimer, the term of this patent is extended or adjusted under 35 U.S.C. 154(b) by 133 days.

(21) Appl. No.: 16/234,647

(22) Filed: Dec. 28, 2018

(65) Prior Publication Data

US 2019/0206297 A1 Jul. 4, 2019

(30) Foreign Application Priority Data

Jan. 3, 2018 (CN) ..... 2018 1 0004711

(51) Int. Cl.
*G09G 3/20* (2006.01)

(52) U.S. Cl.
CPC ..... *G09G 3/20* (2013.01); *G09G 2310/0267* (2013.01); *G09G 2310/08* (2013.01); *G09G 2330/028* (2013.01)

(58) Field of Classification Search
None
See application file for complete search history.

(56) References Cited

U.S. PATENT DOCUMENTS

2002/0195855 A1* 12/2002 Teppo ..... A47C 7/462 297/284.6
2010/0123703 A1* 5/2010 Guo ..... G09G 3/3648 345/211

(Continued)

*Primary Examiner* — Kent W Chang
*Assistant Examiner* — Benjamin Morales
(74) *Attorney, Agent, or Firm* — Brooks Kushman P.C.

(57) ABSTRACT

An amplitude control main circuit, a voltage supply modular circuit, a display device, and an amplitude control method are provided. The amplitude control main circuit includes a variable resistive circuit, an output control circuit and a gate-driving-power-voltage output terminal; the output control circuit is connected to an output control terminal, a voltage input terminal, the gate-driving-power-voltage output terminal, and the variable resistive circuit, and controls, under control of the output control terminal, the gate-driving-power-voltage output terminal to be connected to the voltage input terminal directly or via the variable resistive circuit; a control terminal, a first terminal, and a second terminal of the variable resistive circuit are connected to a resistance control terminal, the output control circuit, and the gate-driving-power-voltage output terminal, respectively, and a resistance value of the variable resistive circuit is changed under control of the resistance control terminal.

12 Claims, 7 Drawing Sheets

(56) References Cited

U.S. PATENT DOCUMENTS

| | | | | |
|---|---|---|---|---|
| 2012/0169695 | A1* | 7/2012 | Chang | G09G 3/3648 345/211 |
| 2012/0206150 | A1* | 8/2012 | Holzer | H03G 1/0088 324/537 |
| 2013/0107152 | A1* | 5/2013 | Okumura | G02F 1/13306 349/41 |
| 2018/0182312 | A1* | 6/2018 | Wang | G02F 1/1368 |

* cited by examiner

AMPLITUDE CONTROL MAIN CIRCUIT, VOLTAGE SUPPLY MODULAR CIRCUIT, DISPLAY DEVICE AND AMPLITUDE CONTROL METHOD

CROSS-REFERENCE TO RELATED APPLICATION

This application claims priority to Chinese Patent Application No. 201810004711.4 filed on Jan. 3, 2018, which is incorporated herein by reference in its entirety.

TECHNICAL FIELD

The present disclosure relates to a field of a voltage control technique, and specifically, relates to an amplitude control main circuit, a voltage provision modular circuit, a display device, and an amplitude control method.

BACKGROUND

Wire resistances of wires connected between a plurality of gate driving sub-circuits included in a gate driving circuit may be generated, and may cause differences between gate-driving on-voltages received by the gate driving sub-circuits, and thus amplitudes of gate driving voltages outputted by the gate driving sub-circuits may be different, thereby causing a screen-division phenomenon of a display panel when displaying an image.

SUMMARY

In a first aspect, an amplitude control main circuit is provided in the present disclosure, and includes a variable resistive circuit, an output control circuit and a gate-driving-power-voltage output terminal. The output control circuit is connected to an output control terminal, a voltage input terminal, the gate-driving-power-voltage output terminal, and the variable resistive circuit, and is configured to control, under a control of the output control terminal, the gate-driving-power-voltage output terminal to be connected to the voltage input terminal directly, or control the gate-driving-power-voltage output terminal to be connected to the voltage input terminal via the variable resistive circuit; a control terminal of the variable resistive circuit is connected to a resistance control terminal, a first terminal of the variable resistive circuit is connected to the output control circuit, and a second terminal of the variable resistive circuit is connected to the gate-driving-power-voltage output terminal, wherein a resistance value of the variable resistive circuit is changed under a control of the resistance control terminal.

Optionally, the output control circuit includes: a switch-control-node control sub-circuit, connected to the output control terminal and a switch control node, and configured to control an electrical potential of the switch control node under a control of the output control terminal; a first switch sub-circuit, connected to the switch control node, the voltage input terminal and the gate-driving-power-voltage output terminal, and configured to control, under a control of the switch control node, the voltage input terminal to be connected to the gate-driving-power-voltage output terminal directly; a phase inversion sub-circuit, wherein an input terminal of the phase inversion sub-circuit is connected to the switch control node and an output terminal of the phase inversion sub-circuit is connected to a phase inversion node, and the phase inversion sub-circuit is configured to invert a phase of the electrical potential of the switch control node and to transmit an electrical potential having the inverted phase to the phase inversion node; and a second switch sub-circuit, connected to the phase inversion node, the first terminal of the variable resistive circuit, and the voltage input terminal, and configured to control, under a control of the phase inversion node, the first terminal of the variable resistive circuit to be connected to the voltage input terminal directly.

Optionally, the switch-control-node control sub-circuit includes a first resistor, a switch control transistor and a second resistor. A first end of the first resistor is connected to the output control terminal, a second terminal of the first resistor is connected to a control electrode of the switch control transistor; a first electrode of the switch control transistor is connected to the switch control node, and a second electrode of the switch control transistor is connected to a low-voltage input terminal; a first end of the second resistor is connected to a high-voltage input terminal, and a second end of the second resistor is connected to the switch control node; the phase inversion sub-circuit includes a phase inverter, an input terminal of the phase inverter is connected to the switch control node, and an output terminal of the phase inverter is connected to the phase inversion node. The first switch sub-circuit includes a first switch transistor, a control electrode of the first switch transistor is connected to the switch control node, a first electrode of the first switch transistor is connected to the voltage input terminal, and a second electrode of the first switch transistor is connected to the gate-driving-power-voltage output terminal. The second switch sub-circuit includes a second switch transistor, a control electrode of the second switch transistor is connected to the phase inversion node, a first electrode of second switch transistor is connected to the voltage input terminal, and a second electrode of the second switch transistor is connected to the first terminal of the variable resistive circuit. The variable resistive circuit includes a programmable resistor, a control terminal of the programmable resistor is connected to the resistance control terminal, a first terminal of the programmable sub-circuit is connected to the second electrode of the second switch transistor, and a second terminal of the programmable resistor is connected to the gate-driving-power-voltage output terminal.

In a second aspect, a voltage supply modular circuit is provided in the present disclosure and includes: the amplitude control main circuit in the first aspect; a voltage supply circuit, connected to the voltage input terminal, and configured to provide a reference power voltage to the voltage input terminal; and a main control circuit, connected to the output control terminal and the resistance control terminal, and configured to provide an output control signal to the output control terminal and provide a resistance control signal to the resistance control terminal.

Optionally, the voltage supply modular circuit according to the present disclosure further includes a gate-driving-on-voltage output terminal and a voltage conversion circuit; wherein the main control circuit is further connected to an output enable terminal, and is configured to output an output enable signal to the output enable terminal. The voltage conversion circuit is connected to the output enable terminal, the gate-driving-power-voltage output terminal and the gate-driving-on-voltage output terminal, and is configured to output an off voltage to the gate-driving-on-voltage output terminal when an electrical potential of the output enable signal is a first electrical potential, and control the gate-driving-power-voltage output terminal and the gate-driving-on-voltage output terminal to be electrically connected when the electrical potential of the output enable signal is a second electrical potential.

In a third aspect, a display device is further provided in the present disclosure and includes a gate driving circuit and the voltage supply modular circuit according to the second aspect; wherein the gate driving circuit includes at least two gate driving sub-circuits cascaded sequentially; the voltage supply modular circuit is configured to output a gate driving power voltage through the gate-driving-power-voltage output terminal; each of the at least two gate driving sub-circuits is configured to control an amplitude of a gate driving voltage signal outputted by the gate driving sub-circuit according to the gate driving power voltage.

Optionally, the voltage supply modular circuit includes a gate-driving-on-voltage output terminal and a voltage conversion circuit, the main control circuit included in the voltage supply modular circuit is connected to the output enable terminal, and is configured to output an output enable signal to the output enable terminal; the voltage conversion circuit is connected to the output enable terminal, the gate-driving-power-voltage output terminal and the gate-driving-on-voltage output terminal, and is configured to output an off voltage to the gate-driving-on-voltage output terminal when an electrical potential of the output enable signal is a first electrical potential, and control the gate-driving-power-voltage output terminal and the gate-driving-on-voltage output terminal to be electrically connected when the electrical potential of the output enable signal is a second electrical potential; the voltage supply modular circuit is connected to the gate driving sub-circuits through the gate-driving-on-voltage output terminal; each of the at least two gate driving sub-circuits is configured to generate a gate driving voltage corresponding to the gate-driving sub-circuit according to a gate driving on-voltage outputted by the gate driving on-voltage output terminal.

Optionally, the display device further includes a power circuit and a timing control circuit. The gate-driving-power-voltage output terminal, the gate-driving-on-voltage output terminal and the voltage supply circuit included in the voltage supply modular circuit are in the power circuit; the main control circuit included in the voltage supply modular circuit is in the timing control circuit.

In a fourth aspect, an amplitude control method applied to the display device according to the third aspect is provided in the present disclosure, and includes: providing the reference power voltage to the voltage input terminal by the voltage supply circuit included in the voltage supply modular circuit, outputting the output control signal to the output control terminal by the main control circuit included in the voltage supply modular circuit, and providing the resistance control signal to the resistance control terminal by the main control circuit so as to control a resistance value of the variable resistive circuit to change according to the resistance control signal; controlling the gate-driving-power-voltage output terminal to be connected directly to the voltage input terminal, or controlling the gate-driving-power-voltage output terminal to be connected to the voltage input terminal via the variable resistive circuit, by the output control circuit included in the amplitude control main circuit in the voltage supply modular circuit under control of the output control signal; controlling an amplitude of a gate driving voltage signal by a gate driving sub-circuit included in a gate driving circuit according to a gate driving power voltage outputted by the gate-driving-power-voltage output terminal.

Optionally, the voltage supply modular circuit further includes a gate-driving-on-voltage output terminal and a voltage conversion circuit. The amplitude control method further includes: providing an output enable signal to the output enable terminal by the main control circuit; outputting an off voltage to the gate-driving-on-voltage output terminal by the voltage conversion circuit when an electrical potential of the output enable signal is a first electrical potential, and controlling the gate-driving-power-voltage output terminal to be electrically connected to the gate-driving-on-voltage output terminal by the voltage conversion circuit when the electrical potential of the output enable signal is a second electrical potential. The controlling an amplitude of a gate driving voltage signal by a gate driving sub-circuit included in a gate driving circuit according to a gate driving power voltage outputted by the gate-driving-power-voltage output terminal, includes: generating a gate driving voltage corresponding to a gate driving sub-circuit by the gate driving sub-circuit according to a gate driving on-voltage outputted by the gate-driving-on-voltage output terminal.

DETAILED DESCRIPTION

Technical solutions of some embodiments of the present disclosure will be described clearly and briefly hereinafter in combination with drawings of the present disclosure. Obviously, the described embodiments are only a part, rather than all, of the embodiments of the present disclosure. All other embodiments obtained by one skilled in the art without paying any creative labor based on the embodiments of the present disclosure fall into the scope of the present disclosure.

All of transistors described in all embodiments of the present disclosure may be triodes, thin-film transistors, field effect transistors or other devices having similar characteristics. In some embodiments of the present disclosure, a control electrode of a transistor may be a base electrode or a gate electrode; in order to differentiate two electrodes other than the control electrode of the transistor, one of the two electrodes is referred to as a first electrode, and the other of the two electrodes is referred to as a second electrode.

In actual applications, in case that the control electrode is the base electrode, the first electrode may be a collector, and the second electrode may be an emitter; or the first electrode may be the emitter, and the second electrode may be the collector.

In actual applications, in case that the control electrode is the gate electrode, the first electrode may be a drain electrode, and the second electrode may be a source electrode; or the first electrode may be the source electrode, and the second electrode may be the drain electrode.

An amplitude control main circuit, a voltage supply modular circuit, a display device, and an amplitude control method are provided in the present disclosure, and may eliminate a screen-division phenomenon caused by different amplitudes of gate driving voltages, due to different lengths of wires between different gate driving sub-circuits and a power circuit for providing a corresponding voltage for a voltage input terminal.

Figure 1:
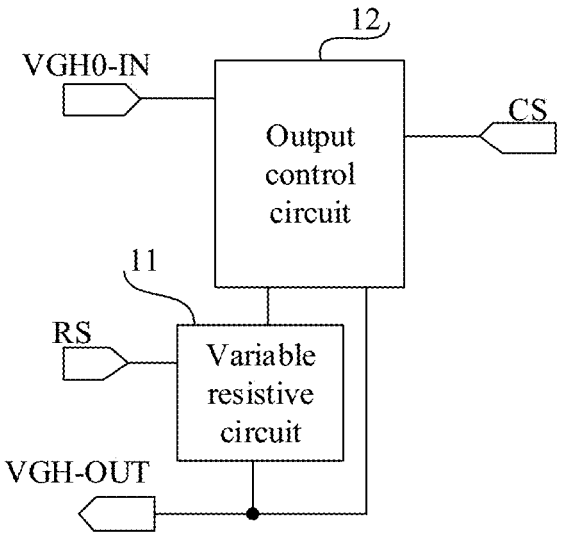
FIG. 1 is a structural diagram of an amplitude control main circuit provided in some embodiments of the present disclosure.

The amplitude control main circuit provided in some embodiments of the present disclosure is configured to control amplitudes of gate driving voltages outputted by at least two gate driving sub-circuits included in a gate driving circuit. As shown in FIG. 1, the amplitude control main circuit includes a variable resistive circuit 11, an output control circuit 12 and a gate-driving-power-voltage output terminal VGH-OUT. The output control circuit 12 is connected to an output control terminal CS, a voltage input terminal VGHO-IN, the gate-driving-power-voltage output terminal VGH-OUT, and the variable resistive circuit 11, and the output control circuit 12 is configured to control, under a control of the output control terminal CS, the gate-driving-power-voltage output terminal VGH-OUT to be connected to the voltage input terminal VGHO-IN directly, or control the gate-driving-power-voltage output terminal VGH-OUT to be connected to the voltage input terminal VGHO-IN via the variable resistive circuit 11.

A control terminal of the variable resistive circuit 11 is connected to a resistance control terminal RS; a first terminal of the variable resistive circuit 11 is connected to the output control circuit 12, and a second terminal of the variable resistive circuit 11 is connected to the gate-driving-power-voltage output terminal VGH-OUT.

A resistance value of the variable resistive circuit 11 may be changed under a control of the resistance control terminal RS.

The amplitude control main circuit provided in some embodiments of present disclosure may control, by using the variable resistive circuit and the output control circuit, different gate driving voltages to be provided to different gate driving sub-circuits. Thus, difference among amplitudes of gate driving voltages due to different lengths of wires between different gate driving sub-circuits and a power circuit for providing a corresponding voltage for the voltage input terminal VGHO-IN may be eliminated, and thus a screen-division phenomenon in the related art may be eliminated, and a uniform image display is implemented.

Figure 2:
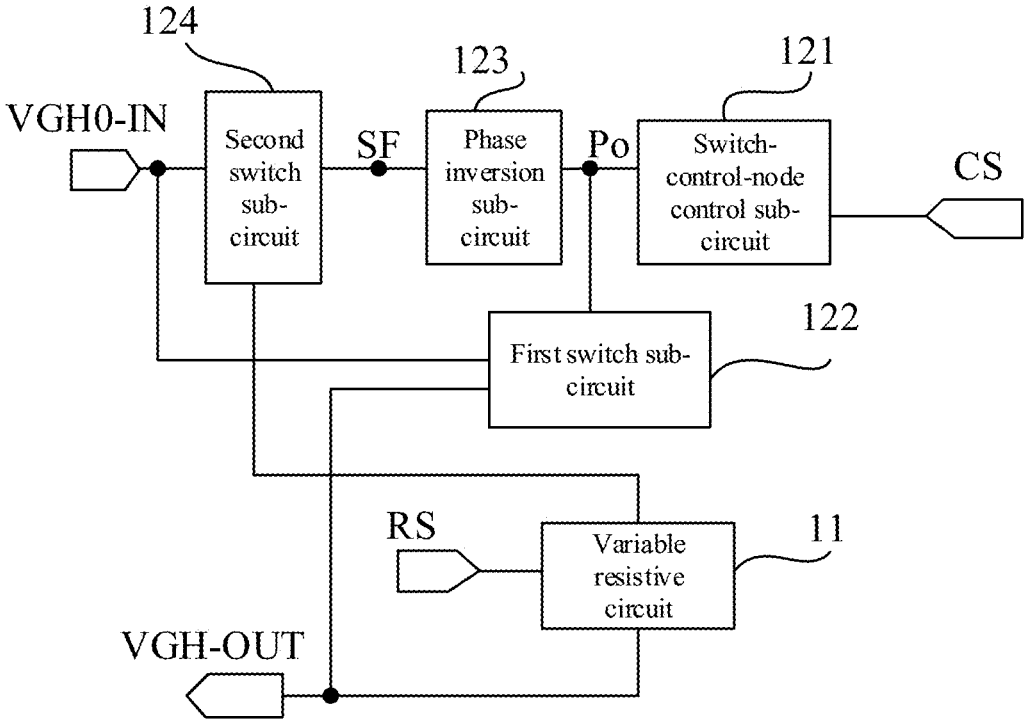
FIG. 2 is another structural diagram of an amplitude control main circuit provided in some embodiments of the present disclosure.

In actual implementations, as shown in FIG. 2, the output control circuit 12 may include a switch-control-node control sub-circuit 121, connected to the output control terminal CS and a switch control node Po and configured to control an electrical potential of the switch control node Po under a control of the output control terminal CS; a first switch sub-circuit 122, connected to the switch control node Po, the voltage input terminal VGHO-IN and the gate-driving-power-voltage output terminal VGH-OUT and configured to control, under a control of the switch control node Po, the voltage input terminal VGHO-IN to be connected to the gate-driving-power-voltage output terminal VGH-OUT directly; a phase inversion sub-circuit 123, wherein an input terminal of the phase inversion sub-circuit 123 is connected to the switch control node Po and an output terminal of the phase inversion sub-circuit 123 is connected to a phase inversion node SF, and the phase inversion sub-circuit 123 is configured to invert a phase of the electrical potential of the switch control node Po, and to transmit an electrical potential having the inverted phase to the phase inversion node SF; and a second switch sub-circuit 124, connected to the phase inversion node SF, the first terminal of the variable resistive circuit 11, and the voltage input terminal VGHO-IN, and configured to control, under a control of the phase inversion node SF, the first terminal of the variable resistive circuit 11 to be connected to the voltage input terminal VGHO-IN directly, wherein the second terminal of the variable resistive circuit 11 is connected to the gate-driving-power-voltage output terminal VGH-OUT.

In the amplitude control main circuit shown in FIG. 2 of the present disclosure, the output control circuit 12 includes the switch-control-node control sub-circuit 121, the first switch sub-circuit 122, the phase inversion sub-circuit 123 and the second switch sub-circuit 124. When the amplitude control main circuit shown in FIG. 2 of the present disclosure operates, the switch-control-node control sub-circuit 121 controls the electrical potential of the switch control node Po under a control of the output control terminal CS; the phase inversion sub-circuit 123 inverts the phase of the electrical potential of the switch control node Po and transmits an electrical potential having the inverted phase to the phase inversion node SF; under the control of the switch control node Po and the phase inversion node SF (i.e., under the control of the output control terminal CS), the first switch circuit 122 and the second switch circuit 124 control the voltage input terminal VGHO-IN to be directly connected to the gate-driving-power-voltage output terminal VGH-OUT, or control the voltage input terminal VGHO-IN to be connected to the gate-driving-power-voltage output terminal VGH-OUT via the variable resistive circuit 11. In this way, a value of a gate driving power voltage outputted by the gate-driving-power-voltage output terminal VGH-OUT is controlled, and an amplitude of a gate driving voltage generated by a corresponding gate driving sub-circuit according to the gate driving power voltage is controlled.

Figure 3:
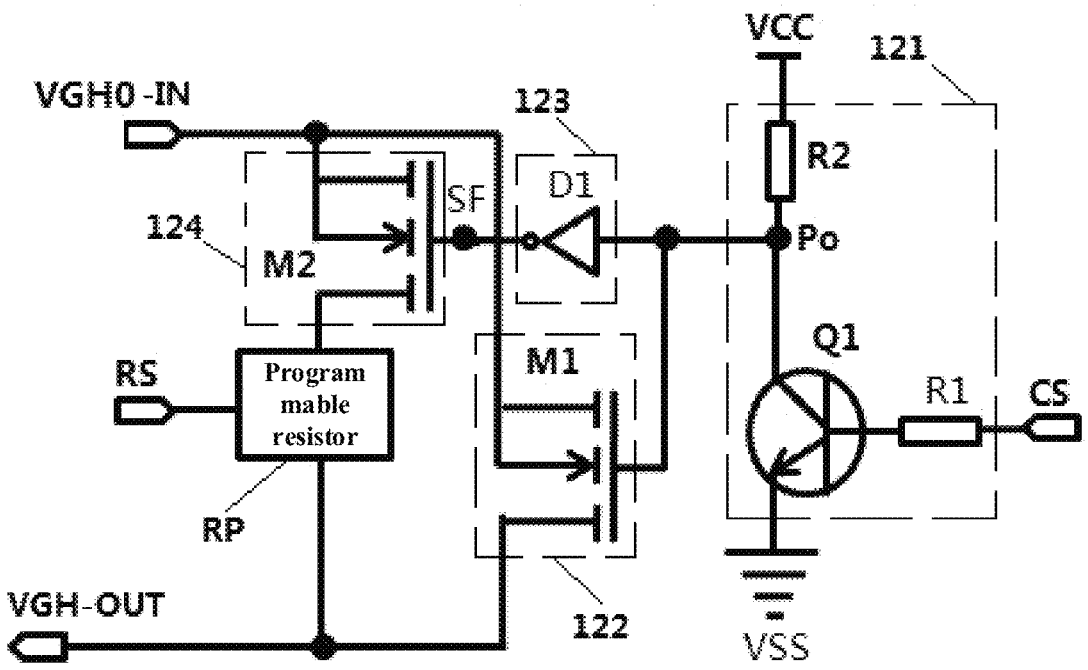
FIG. 3 is a circuitry diagram of an example of an amplitude control main circuit provided in some embodiments of the present disclosure.

In actual implementations, as shown in FIG. 3, the switch-control-node control sub-circuit 121 may include a first resistor R1, a switch control transistor Q1 and a second resistor R2. A first end of the first resistor R1 is connected to the output control terminal CS, a second terminal of the first resistor R1 is connected to a control electrode of the switch control transistor Q1. A first electrode of the switch control transistor Q1 is connected to the switch control node Po, and a second electrode of the switch control transistor Q1 is connected to a low-voltage input terminal inputted with a low voltage VSS. A first end of the second resistor R2 is connected to a high-voltage input terminal inputted with a high voltage VCC, and a second end of the second resistor R2 is connected to the switch control node Po. The phase inversion sub-circuit 123 includes a phase inverter D1. An input terminal of the phase inverter D1 is connected to the switch control node Po, and an output terminal of the phase inverter D1 is connected to the phase inversion node SF. The first switch sub-circuit 122 includes a first switch transistor M1. A control electrode of the first switch transistor M1 is connected to the switch control node Po, a first electrode of first switch transistor M1 is connected to the voltage input terminal VGHO-IN, and a second electrode of the first switch transistor M1 is connected to the gate-driving-power-voltage output terminal VGH-OUT. The second switch sub-circuit 124 includes a second switch transistor M2. A control electrode of the second switch transistor M2 is connected to the phase inversion node SF, a first electrode of the second switch transistor M2 is connected to the voltage input terminal VGHO-IN, and a second electrode of the second switch transistor M2 is connected to the first terminal of the variable resistive circuit 11. The variable resistive circuit includes a programmable resistor RP. A control terminal of the programmable resistor RP is connected to the resistance control terminal RS, a first terminal of the programmable sub-circuit RP is connected to the second electrode of the second switch transistor M2, and a second terminal of the programmable resistor RP is connected to the gate-driving-power-voltage output terminal VGH-OUT.

In FIG. 3, Q1 is a NPN-type triode, a control electrode of the Q1 is a base electrode of the Q1, a first electrode of the Q1 is a collector, and a second electrode of the Q1 is an emitter. In FIG. 3, both the M1 and the M2 are N-Metal-Oxide-Semiconductor (NMOS) transistors, a control electrode of the M1 is a gate electrode of the M1, a first electrode of the M1 is a drain electrode of the M1, and a second electrode of the M1 is a source electrode of the M1; a control electrode of the M2 is a gate electrode of M2, a first electrode of the M2 is a drain electrode of the M2, and a second electrode of the M2 is a source electrode of the M2.

In actual applications, the Q1 may also a PNP-type triode, both the M1 and the M2 may also be P-Metal-Oxide-Semiconductor (PMOS) transistors. In such a case, only electrical potentials of control signals need to be changed accordingly, and thus types of the triodes or transistors are not limited herein.

When the amplitude control main circuit shown in FIG. 3 operates in the present disclosure, if the CS outputs a low voltage level, then the Q1 is turned-off, an electrical potential of the Po is the high voltage, an electrical potential of the SF is the low voltage, the M1 is turned-on, and the M2 is turned off; the VGHO-IN is directly connected to the VGH-OUT, and the VGH-OUT outputs a reference power voltage VGHO.

If the CS outputs the high voltage, then the Q1 is turned-on, the electrical potential of the Po is the low voltage, the electrical potential of the SF is the high voltage, the M1 is turned-off, and the M2 is turned on; the VGHO-IN is connected to the VGH-OUT via the programmable resistor RP, and a resistance value of the RP is changed under a control of the RS, and thereby a value of the gate driving power voltage outputted by the VGH-OUT may be controlled.

A voltage supply modular circuit provided in some embodiments of the present disclosure includes the above amplitude control main circuit.

The voltage supply modular circuit further includes a voltage supply circuit connected to the voltage input terminal and configured to provide the reference power voltage to the voltage input terminal; and a main control circuit, connected to the output control terminal and the resistance control terminal, and configured to provide an output control signal to the output control terminal and provide a resistance control signal to the resistance control terminal.

In actual implementations, the voltage supply modular circuit provided in some embodiments of the present disclosure further includes a gate-driving-on-voltage output terminal and a voltage conversion circuit. The main control circuit is further connected to an output enable terminal, and is configured to output an output enable signal to the output enable terminal. The voltage conversion circuit is connected to the output enable terminal, the gate-driving-power-voltage output terminal and the gate-driving-on-voltage output terminal, and is configured to, when an electrical potential of the output enable signal is a first electrical potential, output an output off voltage to the gate-driving-on-voltage output terminal, and is configured to control the gate-driving-power-voltage output terminal and the gate-driving-on-voltage output terminal to be electrically connected when the electrical potential of the output enable signal is a second electrical potential.

The voltage supply modular circuit provided in some embodiments of the present disclosure includes the voltage supply circuit, the main control circuit and the above amplitude control main circuit. The voltage supply circuit provides the reference power voltage to the voltage input terminal, the main control circuit provides an output control signal to the output control terminal so as to control the gate-driving-power-voltage output terminal to be connected to voltage input terminal directly, or to be connected to the voltage input terminal via the variable resistive circuit. The main control circuit provides the resistance control signal to the resistance control terminal so as to control a resistance value of the variable resistive circuit.

The amplitude control main circuit provided in the voltage supply modular circuit in some embodiments of present disclosure may control different gate driving sub-circuits to be provided with gate driving voltages having different amplitudes, by using the variable resistive circuit and the output control circuit. Thus, difference among amplitudes of gate driving voltages due to different lengths of wires between different gate driving sub-circuits and a power circuit for providing a corresponding voltage for the voltage input terminal VGHO-IN may be eliminated, and thus the screen-division phenomenon in the related art may be improved, and a uniform image display is implemented.

Figure 4:
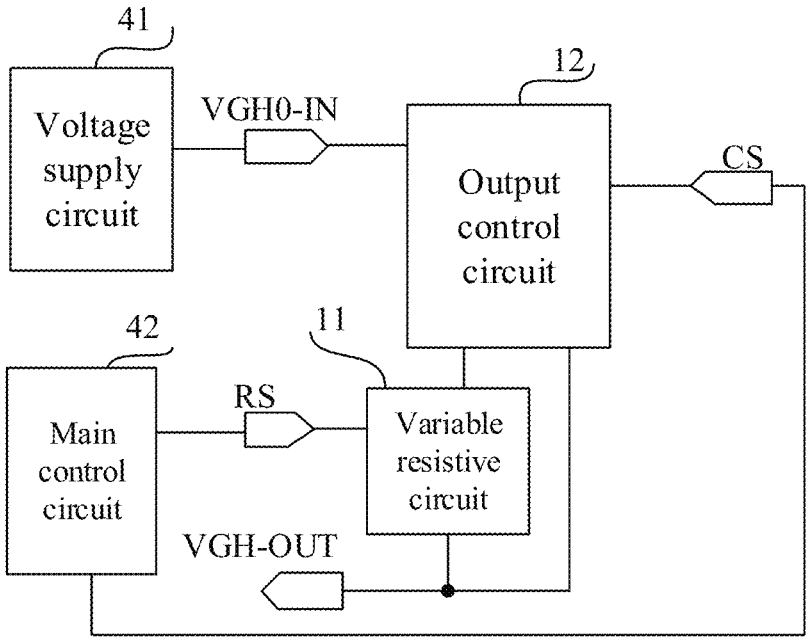
FIG. 4 is a structural diagram of a voltage supply modular circuit provided in some embodiments of the present disclosure.

As shown in FIG. 4, the voltage supply modular circuit provided in some embodiments of the present disclosure includes the above amplitude control main circuit, the voltage supply circuit 41 and the main control circuit 42.

The amplitude control main circuit includes the variable resistive circuit 11, the output control circuit 12 and the gate-driving-power-voltage output terminal VGH-OUT.

The output control circuit 12 is connected to the output control terminal CS, the voltage input terminal VGHO-IN, the gate-driving-power-voltage output terminal VGH-OUT, and the variable resistive circuit 11, and is configured to control, under the control of the output control terminal CS, the gate-driving-power-voltage output terminal VGH-OUT to be connected to the voltage input terminal VGHO-IN directly, or control the gate-driving-power-voltage output terminal VGH-OUT to be connected to the voltage input terminal VGHO-IN via the variable resistive circuit 11.

The control terminal of the variable resistive circuit 11 is connected to the resistance control terminal RS; the first terminal of the variable resistive circuit 11 is connected to the output control circuit 12, and the second terminal of the variable resistive circuit 11 is connected to the gate-driving-power-voltage output terminal VGH-OUT.

The resistance value of the variable resistive circuit 11 may be changed under the control of the resistance control terminal RS. The voltage supply circuit 41 is connected to the voltage input terminal VGHO-IN and is configured to provide the reference power voltage VGHO to the voltage input terminal VGHO-IN. The main control circuit 42 is connected to the output control terminal CS and the resistance control terminal RS, and is configured to provide the output control signal to the output control terminal CS and provide the resistance control signal to the resistance control terminal RS.

The voltage supply modular circuit shown in FIG. 4 of the present disclosure includes the voltage supply circuit 41, the main control circuit 42 and the above amplitude control main circuit. The voltage supply circuit 41 provides the reference power voltage to the voltage input terminal VGHO-IN. The main control circuit 42 provides the output control signal to the output control terminal CS so as to control the gate-driving-power-voltage output terminal VGH-OUT to be connected to voltage input terminal VGH-IN directly, or to be connected to the voltage input terminal VGHO-IN via the variable resistive circuit 11. The main control circuit 42 provides the resistance control signal to the resistance control terminal RS so as to control the resistance value of the variable resistive circuit 11.

Figure 5:
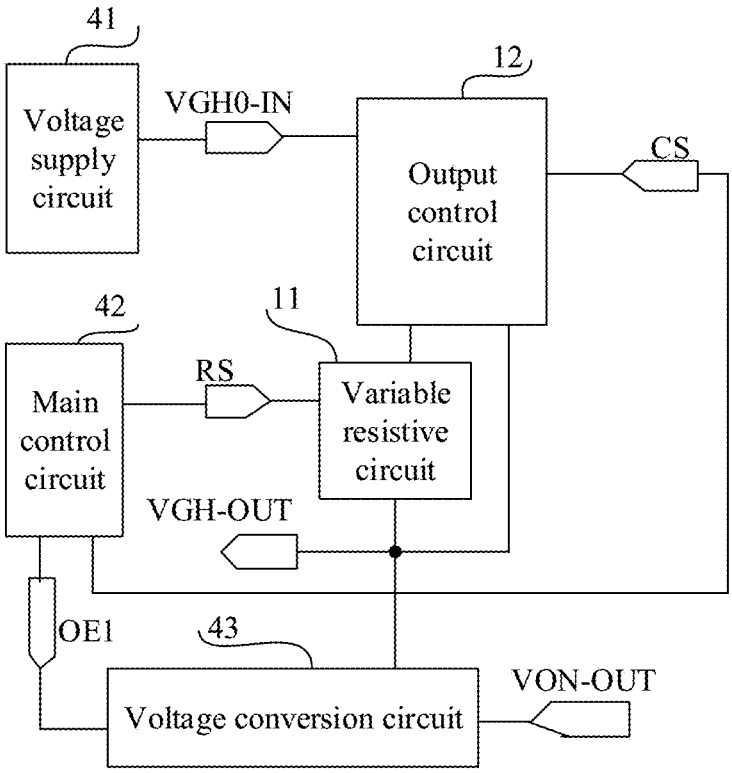
FIG. 5 is another structural diagram of a voltage supply modular circuit provided in some embodiments of the present disclosure.

In actual implementations, as shown in FIG. 5, the voltage supply modular circuit provided in some embodiments of the present disclosure may further include the gate-driving-on-voltage output terminal VON-OUT and a voltage conversion circuit 43.

The main control circuit 42 is further connected to an output enable terminal OE1 and is configured to provide the output enable signal to the output enable terminal OE1.

The voltage conversion circuit 43 is connected to the output enable terminal OE1, the gate-driving-power-voltage output terminal VGH-OUT and the gate-driving-on-voltage output terminal VON-OUT, and is configured to output an off voltage to the gate-driving-on-voltage output terminal VON-OUT when the electrical potential of the output enable signal is the first electrical potential, and the voltage conversion circuit 43 is configured control the gate-driving-power-voltage output terminal VGH-OUT and the gate-driving-on-voltage output terminal VON-OUT to be electrically connected when the electrical potential of the output enable signal is the second electrical potential.

In actual application, each of the gate driving sub-circuits included in the gate driving circuit generates a gate driving voltage corresponding to the gate driving sub-circuit according to the gate driving on-voltage outputted by the gate-driving-on-voltage output terminal VON-OUT corresponding to the gate driving sub-circuit.

In actual implementations, when the electrical potential of the output enable signal outputted by the output enable terminal OE1 is the first electrical potential, the gate-driving-on-voltage output terminal VON-OUT outputs the off voltage, and the off voltage may be the low voltage. The off voltage may cause transistors connected to the gate line corresponding to the gate driving sub-circuit to be turned off. When the electrical potential of the output enable signal outputted by the output enable terminal OE1 is the second electrical potential, the gate-driving-on-voltage output terminal VON-OUT outputs the gate driving power voltage VGH, and a value of the gate driving power voltage VGH is controlled by the resistance control terminal RS and the output control terminal CS.

In actual implementations, the first electrical potential may be the high level, the second electrical potential may be the low level; or the first electrical potential may be the low level, and the second electrical potential may be the high level.

A display device provided in some embodiments of the present disclosure includes the gate driving circuit and the above voltage supply modular circuit.

The gate driving circuit includes at least two gate driving sub-circuits cascaded sequentially. The voltage supply modular circuit is configured to output gate driving power voltages through gate-driving-power-voltage output terminals. The gate driving sub-circuits are configured to control amplitudes of outputted gate driving voltage signals according to the gate driving power voltages.

The amplitude control main circuit provided in the voltage supply modular circuit included in the display device in some embodiments of present disclosure may control different gate driving sub-circuits to be provided with gate driving voltages having different amplitudes, by using the variable resistive circuit and the output control circuit. Thus, difference among amplitudes of the gate driving voltages due to different lengths of wires between different gate driving sub-circuits and the power circuit for providing a corresponding voltage for the voltage input terminal VGHO-IN may be eliminated, and thus the screen-division phenomenon in the related art may be improved, and the uniform image display may be implemented.

The voltage supply modular circuit in the display device provided in some embodiments of the present disclosure includes the voltage supply circuit, the main control circuit and the above amplitude control main circuit. The voltage supply circuit provides the reference power voltage to the voltage input terminal. The main control circuit provides the output control signal to the output control terminal so as to control the gate-driving-power-voltage output terminal to be connected to voltage input terminal directly or to be connected to the voltage input terminal via the variable resistive circuit. The main control circuit provides the resistance control signal to the resistance control terminal so as to control the resistance value of the variable resistive circuit. The voltage supply modular circuit in the display device provided in some embodiments of the present disclosure controls the amplitudes of the gate driving power voltages outputted by the gate-driving-power-voltage output terminals, and thereby amplitudes of gate driving voltages generated by corresponding gate driving sub-circuits may be controlled according to the gate driving power voltages.

In actual implementations, the voltage supply modular circuit may include the gate-driving-on-voltage output terminal and the voltage conversion circuit. The main control circuit included in the voltage supply modular circuit is connected to the output enable terminal, and is configured to output the output enable signal to the output enable terminal. The voltage conversion circuit is configured to output the off voltage to the gate-driving-on-voltage output terminal when the electrical potential of the output enable signal is the first electrical potential, and control the gate-driving-power-voltage output terminal and the gate-driving-on-voltage output terminal to be electrically connected when the electrical potential of the output enable signal is the second electrical potential. The voltage supply modular circuit is connected to the gate driving sub-circuit through the gate-driving-on-voltage output terminal.

The gate driving sub-circuit is specifically configured to generate a gate driving voltage corresponding to the gate driving sub-circuit according to the gate driving on-voltage outputted by the gate-driving-on-voltage output terminal.

In actual application, each of the gate driving sub-circuits included in the gate driving circuit generates the gate driving voltage corresponding to the gate driving sub-circuit, according to the gate driving on-voltage outputted by the gate-driving-on-voltage output terminal VON-OUT corresponding to the gate driving sub-circuit.

In actual implementations, when the electrical potential of the output enable signal outputted by the output enable terminal OE1 is the first electrical potential, the gate-driving-on-voltage output terminal outputs the off voltage, the off voltage may be the low voltage. The off voltage may cause transistors connected to a gate line corresponding to the gate driving sub-circuit to be turned off. When the electrical potential of the output enable signal outputted by the output enable terminal OE1 is the second electrical potential, the gate-driving-on-voltage output terminal VON-OUT outputs the gate driving power voltage VGH, the value of the gate driving power voltage VGH is controlled by the output control terminal CS and the resistance control terminal RS.

Specifically, the display device provided in some embodiments of the present disclosure may also include a power circuit and a timing control circuit. The gate-driving-power-voltage output terminal, the gate-driving-on-voltage output terminal and the voltage supply circuit included in the voltage supply modular circuit are in the power circuit.

The main control circuit included in the voltage supply modular circuit is in the timing control circuit.

The display device of the present disclosure will be described hereinafter by means of a specific example.

Figure 6:
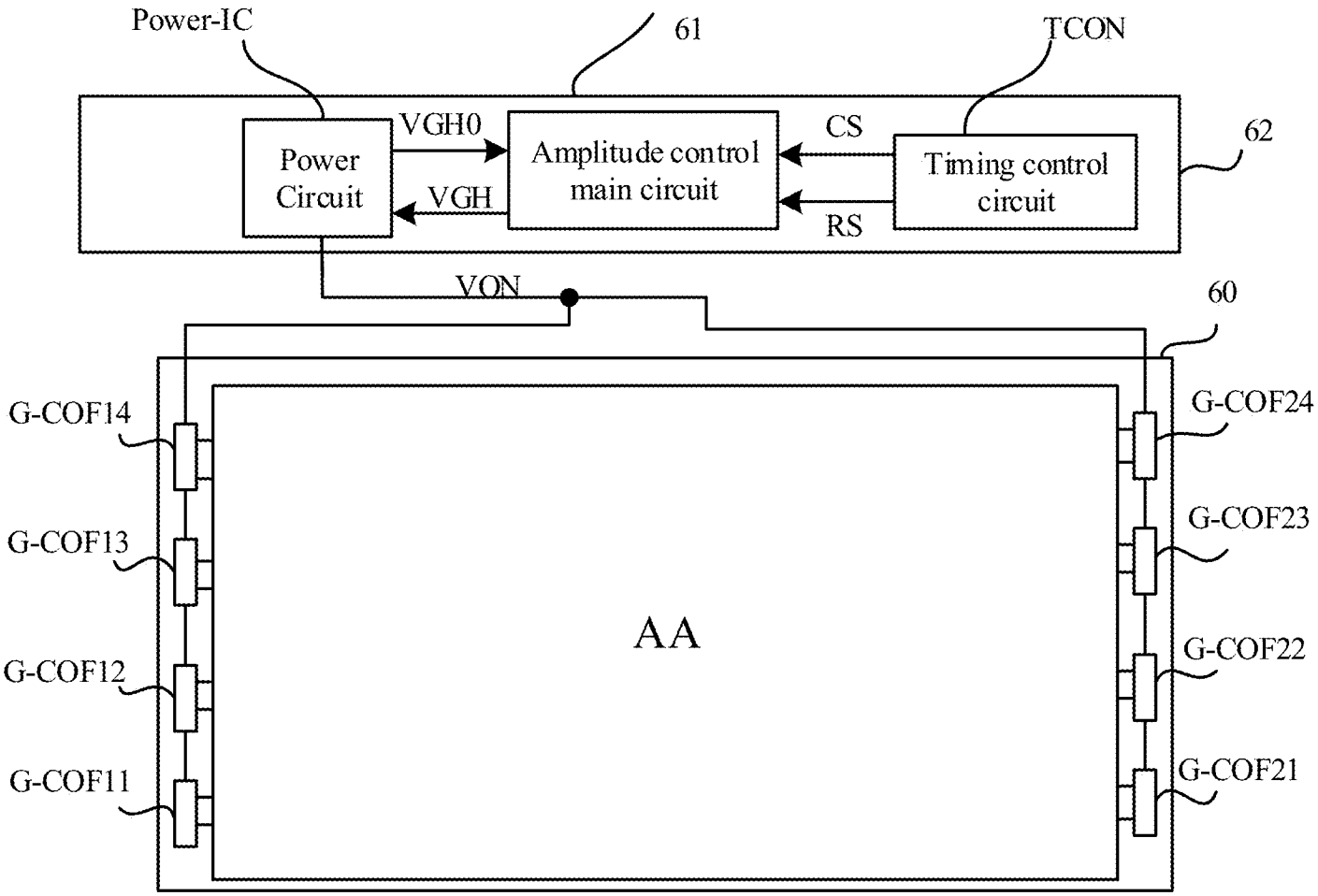
FIG. 6 is a structural diagram of an example of a display device provided in the present disclosure.

As shown in FIG. 6, the specific example of the display device of the present disclosure includes a display panel 60, a gate driving circuit, a power circuit Power-IC, a timing control circuit TCON, and an amplitude control main circuit 61. The power circuit Power-IC, the timing control circuit TCON, and the amplitude control main circuit 61 are arranged on a circuit chip 62.

In FIG. 6, VGHO is a reference power voltage, VGH is a gate driving power voltage, VON is a gate driving on-voltage, CS is an output control terminal, RS is a resistance control terminal, and AA is an active display region.

In the specific example of the display device shown in FIG. 6 of the present disclosure, the gate driving circuit includes four gate driving sub-circuits on a left side of the display panel 60 and four gate driving sub-circuits on a right side of the display panel 60.

The gate driving sub-circuits are on a Chip On Film or a Chip On Flex.

In FIG. 6, a first gate driving sub-circuit on the left side of the display panel 60 is labelled as G-COF11, a second gate driving sub-circuit on the left side of the display panel 60 is labelled as G-COF12, a third gate driving sub-circuit on the left side of the display panel 60 is labelled as G-COF13, and a fourth gate driving sub-circuit on the left side of the display panel 60 is labelled as G-COF14. The first to fourth gate driving sub-circuits G-COF11, G-COF12, G-COF13, and G-COF14 are arranged sequentially from a distal end to a proximal end, wherein the distal end is an end farther away from the circuit chip 62, and the proximal end is an end closer to the circuit chip 62. A first gate driving sub-circuit on the right side of the display panel 60 is labelled as G-COF21, a second gate driving sub-circuit on the right side of the display panel 60 is labelled as G-COF22, a third gate driving sub-circuit on the right side of the display panel 60 is labelled as G-COF23, and a fourth gate driving sub-circuit on the right side of the display panel 60 is labelled as G-COF24. The first to fourth gate driving sub-circuits G-COF 21, G-COF 22, G-COF 23 and G-COF 24 are arranged sequentially from the distal end to the proximal end, wherein the distal end is the end farther away from the circuit chip 62, and the proximal end is the end closer to the circuit chip 62.

Figure 7:
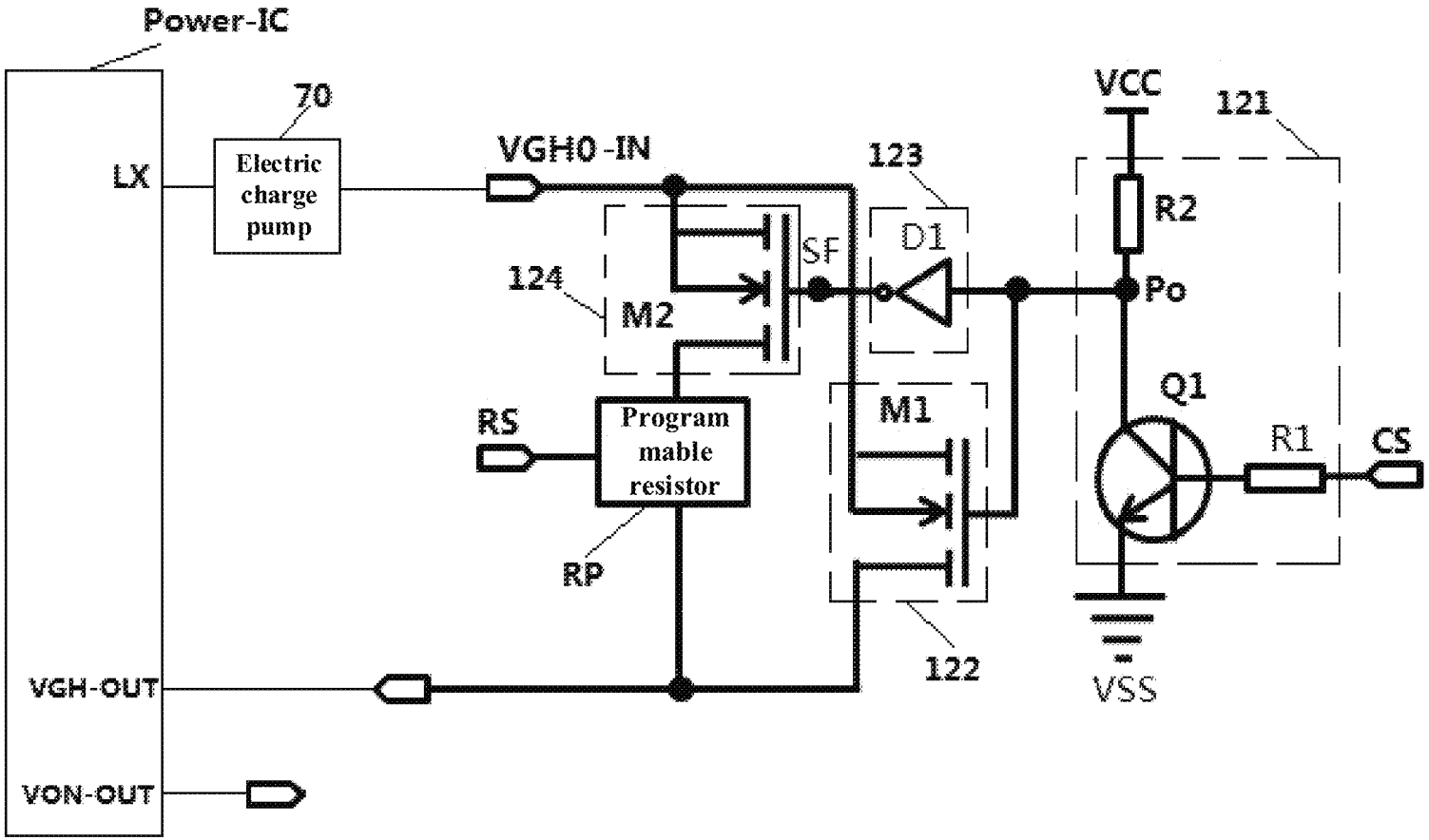
FIG. 7 is a circuitry diagram of an amplitude control main circuit in the example of the display device provided in the present disclosure.

As shown in FIG. 7, the amplitude control main circuit in the specific example of the display device according to the present disclosure includes the variable resistive circuit, the output control circuit and the gate-driving-power-voltage output terminal VGH-OUT; the output control circuit includes the switch-control-node control sub-circuit 121, the first switch sub-circuit 122, the phase inversion sub-circuit 123 and the second switch sub-circuit 124. The switch-control-node control sub-circuit 121 may include the first resistor R1, the switch control transistor Q1 (Q1 is a triode) and the second resistor R2. The first end of the first resistor R1 is connected to the output control terminal CS, and the second terminal of the first resistor R1 is connected to the base electrode of the switch control transistor Q1; the collector of the switch control transistor Q1 is connected to the switch control node Po, and the emitter of the switch control transistor Q1 is connected to the low-voltage input terminal inputted with the low voltage VSS. The first end of the second resistor R2 is connected to the high-voltage input terminal inputted with the high voltage VCC, and the second end of the second resistor R2 is connected to the switch control node Po. The phase inversion sub-circuit 123 includes a phase invertor D1, the input terminal of the phase invertor D1 is connected to the switch control node Po, and the output terminal of the phase invertor D1 is connected to the phase inversion node SF.

The variable resistive circuit includes the programmable resistor RP. The first switch sub-circuit 122 includes the first switch transistor M1 (M1 is a NMOS transistor), the gate electrode of the first switch transistor M1 is connected to the switch control node Po, the drain electrode of the first switch transistor M1 is connected to the voltage input terminal VGHO-IN, and the source electrode of the first switch transistor M1 is connected to the gate-driving-power-voltage output terminal VGH-OUT. The second switch sub-circuit 124 includes the second switch transistor M2 (M2 is a NMOS transistor), the gate electrode of the second switch transistor M2 is connected to the phase inversion node SF, the drain electrode of second switch transistor M2 is connected to the voltage input terminal VGHO-IN, and the source electrode of the second switch transistor M2 is connected to the first terminal of the programmable resistor RP. The control terminal of the programmable resistor RP is connected to the resistance control terminal RS, the first terminal of the programmable sub-circuit RP is connected to the source electrode of the second switch transistor M2, and the second terminal of the programmable resistor RP is connected to the gate-driving-power-voltage output terminal VGH-OUT.

In FIG. 7, the power circuit is labelled as Power-IC, a power terminal is labelled as LX, an electric charge pump is labelled as 70, the voltage input terminal is labelled as VGHO-IN, the gate-driving-power-voltage output terminal is labelled as VGH-OUT, the gate-driving-on-voltage output terminal is labelled as VON-OUT. The LX, VGHO-IN and VGH-OUT are all arranged in the power circuit Power-IC.

In actual operations, the gate driving on-voltage VON passes through the G-COF11, G-COF12, G-COF13 and G-COF14 sequentially, the gate driving on-voltage VON passes through the G-COF21, G-COF 22, G-COF 23 and G-COF24 sequentially. Since wire resistances of wires among the four gate driving sub-circuits on the left side of the display panel 60 may exist, and wire resistances of wires among the four gate driving sub-circuits on the right side of the display panel 60 may exist, gate driving on-voltages received by the G-COF11, G-COF12, G-COF13, and G-COF14 may differ from each other, and gate driving on-voltages received by the G-COF21, G-COF22, G-COF23, and G-COF24 may differ from each other if the amplitude control main circuit provided in some embodiments of the present disclosure is not adopted, causing the phenomenon that an image displayed in the display panel 60 is split into four parts. The specific example of the display device according to the present disclosure adopts an output control signal outputted by TCON as a selection signal for the amplitude control main circuit, values of the gate-driving-power voltages are controlled by using the transistors and programmable resistor and thereby compensating differences among the gate driving on-voltages received by the gate driving sub-circuits, so that amplitudes of the gate driving voltages outputted by the gate driving sub-circuits according to the gate driving on-voltages received by the gate driving circuits are approximately the same, thereby eliminating the phenomenon that the image displayed in the display panel is split into four parts.

An operational flow of the specific example of the display device according to the present disclosure is as follows. gate-driving scan operations of the G-COF11, the G-COF12, the G-COF13, the G-COF14 are performed sequentially, and gate-driving scan operations of the G-COF21, the G-COF22, the G-COF23, the G-COF24 are performed sequentially, i.e., the display panel performs the gate-driving scan operations from the distal end to the proximal end when displaying an image.

Figure 8:
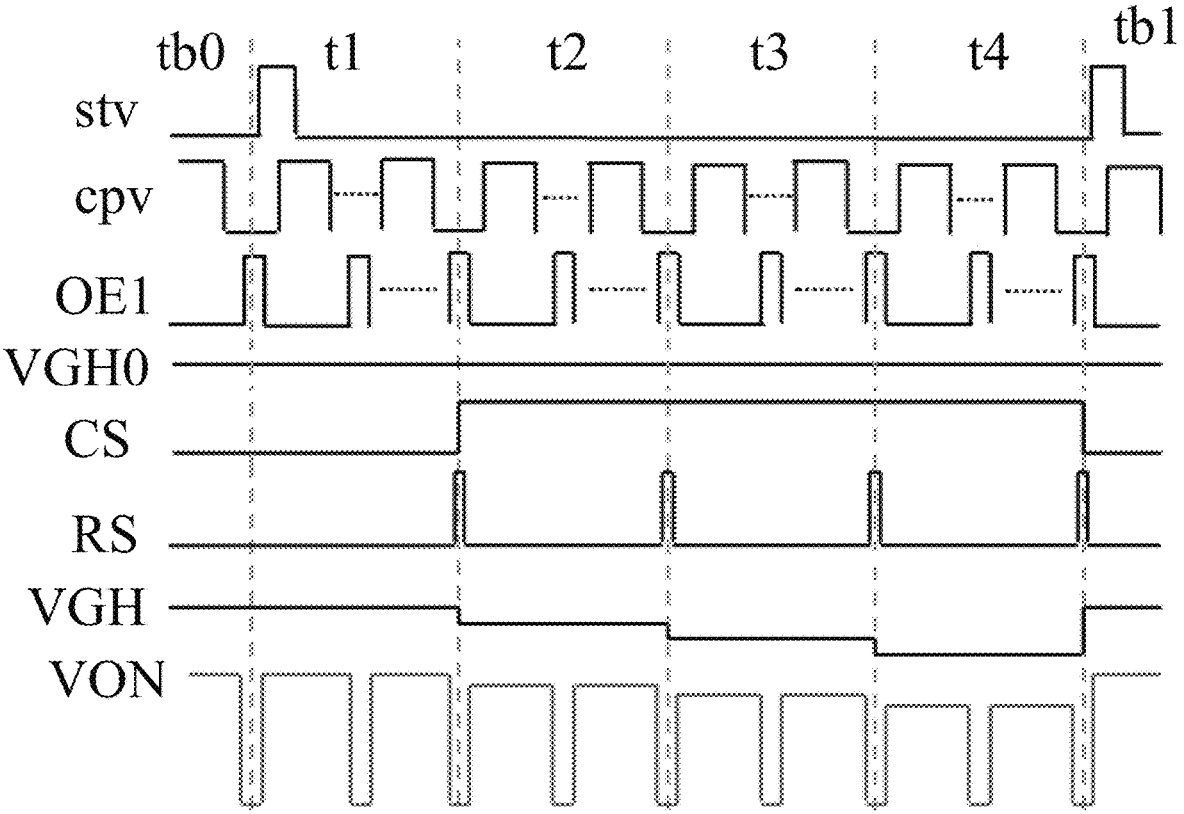
FIG. 8 is a timing diagram of the example of the display device provided in the present disclosure.
Figure 9:
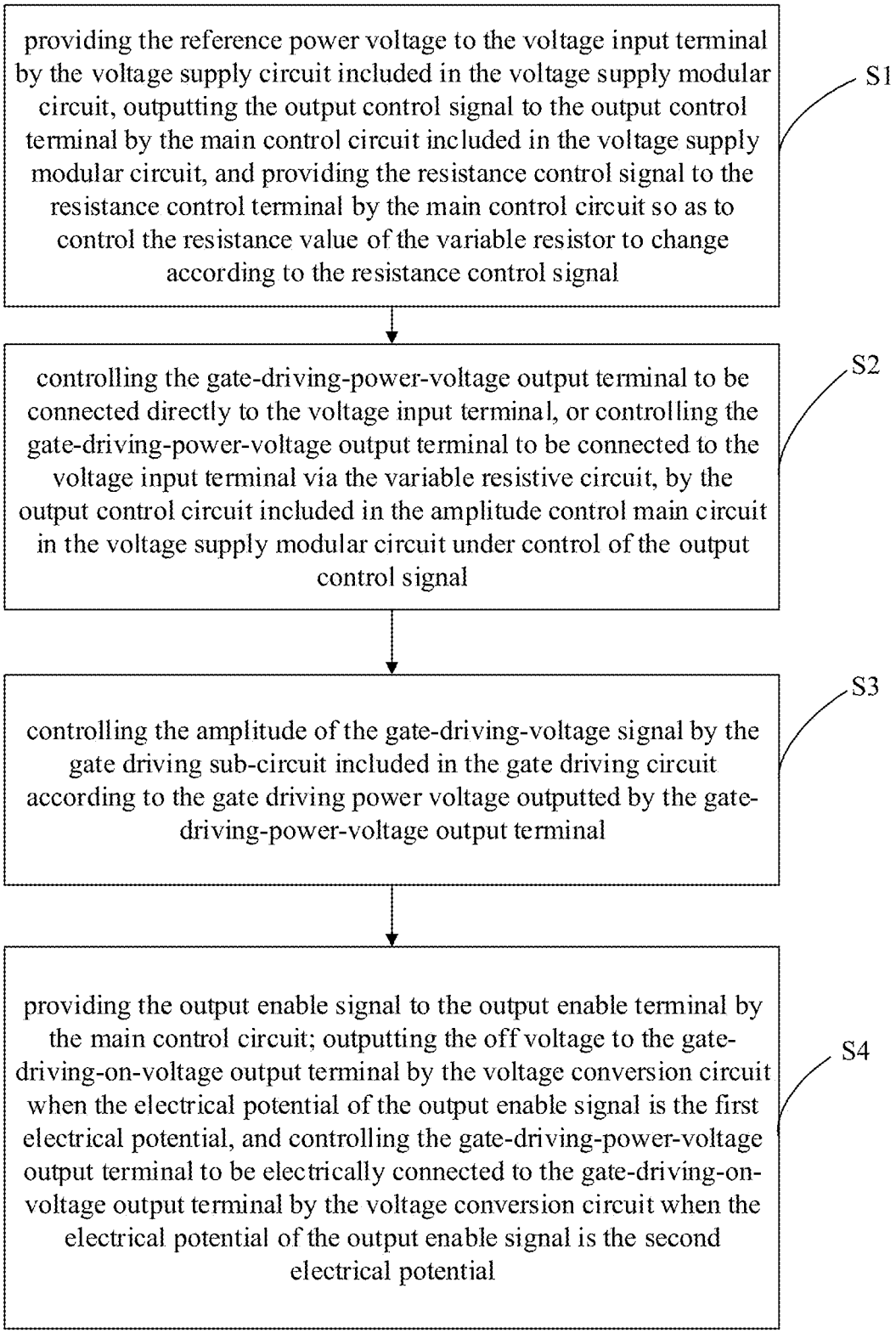
FIG. 9 is a flowchart of an amplitude control method provided in the present disclosure.

As shown in FIG. 8, at a beginning of a duration for displaying a frame, i.e. at a blank time period tb0 and at a first scan time period t1 of the first gate driving sub-circuits, the output control terminal CS outputs a low electrical level, an electrical potential of the switch control node Po is changed to a high electrical level, and an electrical potential of the phase inversion node SF is changed to the low electrical level under an action of the phase inverter D1, the first switch transistor M1 is turned on, and the second switch transistor M2 is turned off, so that the VGH-OUT outputs the reference power voltage VGH0.

After a last gate line driven by the first gate driving sub-circuits is scanned, and at a second scan time period t2 of the second gate driving sub-circuits, the output control terminal CS outputs the high electrical level, the electrical potential of the switch control node Po is changed to the low electrical level, and the electrical potential of the phase inversion node SF is changed to the high electrical level under the action of the phase inverter D1, the first switch transistor M1 is turned off, the second switch transistor M2 is turned on, and a resistance value of the programmable resistor RP is changed to 'r' under a control of the resistance control terminal RS, wherein the r is a predetermined resistance value, and the gate-driving-power-voltage output terminal VGH-OUT outputs the first power voltage VGH1.

After a last gate line driven by the second gate driving sub-circuits is scanned, and at a third scan time period t3 of the third gate driving sub-circuits, the output control terminal CS outputs the high electrical level, the electrical potential of the switch control node Po is still the low electrical level, and the electrical potential of the phase inversion node SF is changed to the high electrical level under the action of the phase inverter D1, the first switch transistor M1 is turned off, the second switch transistor M2 is turned on, and the resistance value of the programmable resistor RP is changed to '2r' under a control of the resistance control terminal RS, and the gate-driving-power-voltage output terminal VGH-OUT outputs a second gate driving power voltage VGH2.

After a last gate line driven by the third gate driving sub-circuits is scanned, and at a fourth scan time period t4 of the fourth gate driving sub-circuits, the output control terminal CS outputs the high electrical level, the electrical potential of the switch control node Po is still the low electrical level, and the electrical potential of the phase inversion node SF is changed to the high electrical level under the action of the phase inverter D1, the first switch transistor M1 is turned off, the second switch transistor M2 is turned on, and the resistance value of the programmable resistor RP is changed to '3r' under a control of the resistance control terminal RS, and the gate-driving-power-voltage output terminal VGH-OUT outputs a third gate driving power voltage VGH3.

After a last gate line driven by the fourth gate driving sub-circuits is scanned, a next blank time period tb1 starts, the output control terminal CS outputs the low electrical level again, and the gate-driving-power-voltage output terminal VGH-OUT outputs the reference power voltage VGH0.

When the specific example of the display device according to the present disclosure operates, the reference power voltage VGH0 is larger than the first power voltage VGH1, the first power voltage VGH1 is larger than the second power voltage VGH2, the second power voltage VGH2 is larger than the third power voltage VGH3, and voltage differences among the gate driving sub-circuits are compensated by setting a value of the 'r'. In actual applications, the 'r' may be a wire resistance between two adjacent ones of the gate driving sub-circuits.

In FIG. 8, the output enable terminal OE1 outputs an enable signal, CPV is a Clock Pulse Vertical signal, STV is a start signal. When the electrical potential of the output enable terminal OE1 is the high electrical level, the electrical potential of the gate driving on-voltage VON is the low electrical level (i.e., the off voltage); and, when the electrical potential of the output enable terminal OE1 is the low electrical level, the electrical potential of the gate driving on-voltage VON equals to the gate-driving power voltage.

In the specific example of the display device according to the present disclosure, selection of the gate driving power voltages outputted by the gate-driving-on-voltage output terminal VGH-OUT is controlled by the TCON, a response time is short, and values of the gate driving power voltages are adjusted by software.

Some embodiments of the present disclosure further provide an amplitude control method applied to the above display device. The amplitude control method includes steps S1 to S3 as follow.

Step S1: providing the reference power voltage to the voltage input terminal by the voltage supply circuit included in the voltage supply modular circuit, outputting the output control signal to the output control terminal by the main control circuit included in the voltage supply modular circuit, and providing the resistance control signal to the resistance control terminal by the main control circuit so as to control the resistance value of the variable resistive circuit to change according to the resistance control signal.

Step S2: controlling the gate-driving-power-voltage output terminal to be connected directly to the voltage input terminal, or controlling the gate-driving-power-voltage output terminal to be connected to the voltage input terminal via the variable resistive circuit, by the output control circuit included in the amplitude control main circuit in the voltage supply modular circuit under control of the output control signal.

Step S3: controlling the amplitude of the gate-driving-voltage signal by the gate driving sub-circuit included in the gate driving circuit according to the gate driving power voltage outputted by the gate-driving-power-voltage output terminal.

Specifically, the voltage supply modular circuit may further include the gate-driving-on-voltage output terminal and the voltage conversion circuit, and the amplitude control method further includes a step S4.

Step S4: providing the output enable signal to the output enable terminal by the main control circuit; outputting the off voltage to the gate-driving-on-voltage output terminal by the voltage conversion circuit when the electrical potential of the output enable signal is the first electrical potential, and controlling the gate-driving-power-voltage output terminal to be electrically connected to the gate-driving-on-voltage output terminal by the voltage conversion circuit when the electrical potential of the output enable signal is the second electrical potential.

The step S3 of controlling the amplitude of the gate-driving-voltage signal by the gate driving sub-circuit included in the gate driving circuit according to the gate driving power voltage outputted by the gate-driving-power-voltage output terminal, specifically includes: generating the gate driving voltage corresponding to the gate driving sub-circuit by the gate driving sub-circuit according to the gate driving on-voltage outputted by the gate-driving-on-voltage output terminal.

The amplitude control main circuit, the voltage supply modular circuit, the display device, and the amplitude control method provided in some embodiments of present disclosure may control different gate driving sub-circuits to be provided with different gate driving voltages, by using the variable resistive circuit and the output control circuit. Thus, differences among the amplitudes of the gate driving voltages due to different lengths of wires between different gate driving sub-circuits and the power circuit for providing a corresponding voltage for the voltage input terminal VGHO-IN may be eliminated, and thus the phenomenon of split screens in the related art may be improved, and the uniform image display is implemented.

The above described embodiments of the present disclosure are optional embodiments. It should be noted that numerous modifications and embellishments may be made by one of ordinary skills in the art without departing from the spirit of the present disclosure, and such modifications and embellishments also fall within the scope of the present disclosure.

What is claimed is:

1. An amplitude control main circuit, comprising:

a variable resistive circuit, an output control circuit and a gate-driving-power-voltage output terminal;

wherein the output control circuit is connected to an output control terminal, a voltage input terminal, the gate-driving-power-voltage output terminal, and the variable resistive circuit, and is configured to control, under a control of the output control terminal, the gate-driving-power-voltage output terminal to be connected to the voltage input terminal directly, or control the gate-driving-power-voltage output terminal to be connected to the voltage input terminal via the variable resistive circuit;

a control terminal of the variable resistive circuit is connected to a resistance control terminal, a first terminal of the variable resistive circuit is connected to the output control circuit, and a second terminal of the variable resistive circuit is connected to the gate-driving-power-voltage output terminal, wherein a resistance value of the variable resistive circuit is changed under a control of the resistance control terminal.

2. The amplitude control main circuit according to claim 1, wherein the output control circuit comprises:

a switch-control-node control sub-circuit, connected to the output control terminal and a switch control node, and configured to control an electrical potential of the switch control node under a control of the output control terminal;

a first switch sub-circuit, connected to the switch control node, the voltage input terminal and the gate-driving-power-voltage output terminal, and configured to control, under a control of the switch control node, the voltage input terminal to be connected to the gate-driving-power-voltage output terminal directly;

a phase inversion sub-circuit, wherein an input terminal of the phase inversion sub-circuit is connected to the switch control node and an output terminal of the phase inversion sub-circuit is connected to a phase inversion node, and the phase inversion sub-circuit is configured to invert a phase of the electrical potential of the switch control node and to transmit an electrical potential having the inverted phase to the phase inversion node; and a second switch sub-circuit, connected to the phase inversion node, the first terminal of the variable resistive circuit, and the voltage input terminal, and configured to control, under a control of the phase inversion node, the first terminal of the variable resistive circuit to be connected to the voltage input terminal directly.

3. The amplitude control main circuit according to claim 2, wherein, the switch-control-node control sub-circuit comprises a first resistor, a switch control transistor and a second resistor; a first end of the first resistor is connected to the output control terminal, a second terminal of the first resistor is connected to a control electrode of the switch control transistor; a first electrode of the switch control transistor is connected to the switch control node, and a second electrode of the switch control transistor is connected to a low-voltage input terminal; a first end of the second resistor is connected to a high-voltage input terminal, and a second end of the second resistor is connected to the switch control node;

the phase inversion sub-circuit comprises a phase inverter, an input terminal of the phase inverter is connected to the switch control node, and an output terminal of the phase inverter is connected to the phase inversion node;

the first switch sub-circuit comprises a first switch transistor, a control electrode of the first switch transistor is connected to the switch control node, a first electrode of the first switch transistor is connected to the voltage input terminal, and a second electrode of the first switch transistor is connected to the gate-driving-power-voltage output terminal;

the second switch sub-circuit comprises a second switch transistor, a control electrode of the second switch transistor is connected to the phase inversion node, a first electrode of second switch transistor is connected to the voltage input terminal, and a second electrode of the second switch transistor is connected to the first terminal of the variable resistive circuit;

the variable resistive circuit comprises a programmable resistor, a control terminal of the programmable resistor is connected to the resistance control terminal, a first terminal of the programmable sub-circuit is connected to the second electrode of the second switch transistor, and a second terminal of the programmable resistor is connected to the gate-driving-power-voltage output terminal.

4. A voltage supply modular circuit, comprising:

the amplitude control main circuit according to claim 1;

a voltage supply circuit, connected to the voltage input terminal, and configured to provide a reference power voltage to the voltage input terminal; and a main control circuit, connected to the output control terminal and the resistance control terminal, and configured to provide an output control signal to the output control terminal and provide a resistance control signal to the resistance control terminal.

5. The voltage supply modular circuit according to claim 4, further comprising:

a gate-driving-on-voltage output terminal and a voltage conversion circuit;

wherein the main control circuit is further connected to an output enable terminal, and is configured to output an output enable signal to the output enable terminal;

the voltage conversion circuit is connected to the output enable terminal, the gate-driving-power-voltage output terminal and the gate-driving-on-voltage output terminal, and is configured to output an off voltage to the gate-driving-on-voltage output terminal when an electrical potential of the output enable signal is a first electrical potential, and control the gate-driving-power-voltage output terminal and the gate-driving-on-voltage output terminal to be electrically connected when the electrical potential of the output enable signal is a second electrical potential.

6. A voltage supply modular circuit, comprising:

the amplitude control main circuit according to claim 2;

a voltage supply circuit, connected to the voltage input terminal, and configured to provide a reference power voltage to the voltage input terminal; and a main control circuit, connected to the output control terminal and the resistance control terminal, and configured to provide an output control signal to the output control terminal and provide a resistance control signal to the resistance control terminal.

7. A voltage supply modular circuit, comprising:

the amplitude control main circuit according to claim 3;

a voltage-provision circuit, connected to the voltage input terminal, and configured to provide a reference power voltage to the voltage input terminal; and a main control circuit, connected to the output control terminal and the resistance control terminal, and configured to provide an output control signal to the output control terminal and provide a resistance control signal to the resistance control terminal.

8. A display device, comprising:

a gate driving circuit and the voltage supply modular circuit according to claim 4;

wherein the gate driving circuit comprises at least two gate driving sub-circuits cascaded sequentially;

the voltage supply modular circuit is configured to output a gate driving power voltage through the gate-driving-power-voltage output terminal;

each of the at least two gate driving sub-circuits is configured to control an amplitude of a gate driving voltage signal outputted by the gate driving sub-circuit according to the gate driving power voltage.

9. The display device according to claim 8, wherein the voltage supply modular circuit comprises a gate-driving-on-voltage output terminal and a voltage conversion circuit, the main control circuit comprised in the voltage supply modular circuit is connected to the output enable terminal, and is configured to output an output enable signal to the output enable terminal;

the voltage conversion circuit is connected to the output enable terminal, the gate-driving-power-voltage output terminal and the gate-driving-on-voltage output terminal, and is configured to output an off voltage to the gate-driving-on-voltage output terminal when an electrical potential of the output enable signal is a first electrical potential, and control the gate-driving-power-voltage output terminal and the gate-driving-on-voltage output terminal to be electrically connected when the electrical potential of the output enable signal is a second electrical potential;

the voltage supply modular circuit is connected to the gate driving sub-circuits through the gate-driving-on-voltage output terminal;

each of the at least two gate driving sub-circuits is configured to generate a gate driving voltage corresponding to the gate-driving sub-circuit according to a gate driving on-voltage outputted by the gate driving on-voltage output terminal.

10. The display device according to claim 7, further comprising:

a power circuit and a timing control circuit;

the gate-driving-power-voltage output terminal, the gate-driving-on-voltage output terminal and the voltage supply circuit comprised in the voltage supply modular circuit are in the power circuit;

the main control circuit comprised in the voltage supply modular circuit is in the timing control circuit.

11. An amplitude control method applied to the display device according to claim 8, comprising:

providing the reference power voltage to the voltage input terminal by the voltage supply circuit comprised in the voltage supply modular circuit, outputting the output control signal to the output control terminal by the main control circuit comprised in the voltage supply modular circuit, and providing the resistance control signal to the resistance control terminal by the main control circuit so as to control a resistance value of the variable resistive circuit to change according to the resistance control signal;

controlling the gate-driving-power-voltage output terminal to be connected directly to the voltage input terminal, or controlling the gate-driving-power-voltage output terminal to be connected to the voltage input terminal via the variable resistive circuit, by the output control circuit comprised in the amplitude control main circuit in the voltage supply modular circuit under control of the output control signal;

controlling an amplitude of a gate driving voltage signal by a gate driving sub-circuit comprised in a gate driving circuit according to a gate driving power voltage outputted by the gate-driving-power-voltage output terminal.

12. The amplitude control method according to claim 11, wherein the voltage supply modular circuit further comprises a gate-driving-on-voltage output terminal and a voltage conversion circuit; and the main control circuit is further connected to an output enable terminal, and is configured to output an output enable signal to the output enable terminal; the voltage conversion circuit is connected to the output enable terminal, the gate-driving-power-voltage output terminal and the gate-driving-on-voltage output terminal; the amplitude control method further comprises:

providing an output enable signal to the output enable terminal by the main control circuit; outputting an off voltage to the gate-driving-on-voltage output terminal by the voltage conversion circuit when an electrical potential of the output enable signal is a first electrical potential, and controlling the gate-driving-power-voltage output terminal to be electrically connected to the gate-driving-on-voltage output terminal by the voltage conversion circuit when the electrical potential of the output enable signal is a second electrical potential;

the controlling an amplitude of a gate driving voltage signal by a gate driving sub-circuit comprised in a gate driving circuit according to a gate driving power voltage outputted by the gate-driving-power-voltage output terminal, comprises:

generating a gate driving voltage corresponding to a gate driving sub-circuit by the gate driving sub-circuit according to a gate driving on-voltage outputted by the gate-driving-on-voltage output terminal.

* * * * *